US010625836B1

(12) United States Patent
Maresh

(10) Patent No.: US 10,625,836 B1
(45) **Date of Patent: *Apr. 21, 2020**

(54) SCUBA PROPULSION APPARATUS HAVING AN OSCILLATING FIN

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/057,798

(22) Filed: Aug. 7, 2018

Related U.S. Application Data

(63) Continuation-in-part of application No. 15/618,100, filed on Jun. 8, 2017, which is a continuation of application No. 14/930,997, filed on Nov. 3, 2015, now Pat. No. 9,676,459.

(60) Provisional application No. 62/605,278, filed on Aug. 7, 2017.

(51) Int. Cl.

| | |
|---|---|
| ***B63H 1/30*** | (2006.01) |
| ***B63H 16/08*** | (2006.01) |
| ***B63H 16/20*** | (2006.01) |
| ***B63H 1/36*** | (2006.01) |

(52) U.S. Cl.
CPC ..... *B63H 16/08* (2013.01); *B63H 1/36* (2013.01); *B63H 16/20* (2013.01); *B63H 2016/202* (2013.01)

(58) Field of Classification Search
CPC ... B63H 1/32; B63H 1/36; B63H 5/00; B63H 2005/00
USPC ..... 440/6, 13–15; 114/315
See application file for complete search history.

(56) References Cited

U.S. PATENT DOCUMENTS

| | | | | |
|---|---|---|---|---|
| 3,329,118 A * | 7/1967 | Strader | ..... | A63B 35/12 114/315 |
| 3,995,578 A * | 12/1976 | McCullough | ..... | A63B 35/12 440/6 |
| 4,467,742 A * | 8/1984 | Duboy | ..... | A63B 35/12 114/315 |
| 4,843,998 A * | 7/1989 | Parker | ..... | A63B 35/12 114/315 |
| 5,365,868 A * | 11/1994 | Culotta | ..... | A63B 35/12 114/315 |
| 7,654,215 B2 * | 2/2010 | Vitale | ..... | B63C 11/46 114/315 |

* cited by examiner

*Primary Examiner* — Daniel V Venne
(74) *Attorney, Agent, or Firm* — Nick A Nichols, Jr.

(57) ABSTRACT

In an oscillating fin propulsion apparatus adapted for use by a disabled diver, a propulsion force may be produced by a fin adapted to sweep back and forth in a generally transverse direction relative to the traveling direction of the diver. The fin may be mounted on a scuba tank operatively connected to drive members that may be reciprocated by the diver. The oscillating fin may provide a propulsive force propelling the diver forward during both oscillating directions of the fin.

6 Claims, 5 Drawing Sheets

108
106
120
112
118
116
102
122
114
100

SCUBA PROPULSION APPARATUS HAVING AN OSCILLATING FIN

CROSS-REFERENCE TO RELATED APPLICATION

This application claims priority to and the benefit of the filing date of U.S. Provisional Application Ser. No. 62/605,278, filed Aug. 7, 2017, and is a continuation-in-part of U.S. patent application Ser. No. 15/618,100, filed Jun. 6, 2017, which is a continuation of U.S. patent application Ser. No. 14/930,997, filed Nov. 3, 2015, now U.S. Pat. No. 9,676,459, which applications are herein incorporated by reference in their entirety.

BACKGROUND

The present invention relates to an oscillating fin apparatus, more particularly, to scuba equipment having an oscillating fin which may be powered by a diver.

Scuba divers that have lower body disabilities are typically unable to propel their body through water at a significant rate by use of their arms alone. Organizations, such as the International Association for Handicapped Divers (IAHD) has provided programs to teach and certify dive instructors how to train and supervise physically disabled divers.

It is therefore an object of the present disclosure to enable handicapped divers the ability to move through water using solely the diver's upper body (arms) at submerged speeds comparable to divers who are able-bodied and using the diver's lower body with foot fins.

It is another object of the present disclosure to enable able-bodied divers to alternate between upper body propulsion and lower body propulsion, or some combination thereof, in order to minimize muscle cramping and the like, or simply to use the oscillating fin as a steering or yaw control rudder.

SUMMARY

In an oscillating fin propulsion apparatus adapted for use by a disabled diver, a propulsion force may be produced by a fin adapted to sweep back and forth in a generally transverse direction relative to the traveling direction of the diver. The fin may be mounted on a scuba tank operatively connected to drive members that may be reciprocated by the diver. The oscillating fin may provide a propulsive force propelling the diver forward during both oscillating directions of the fin.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
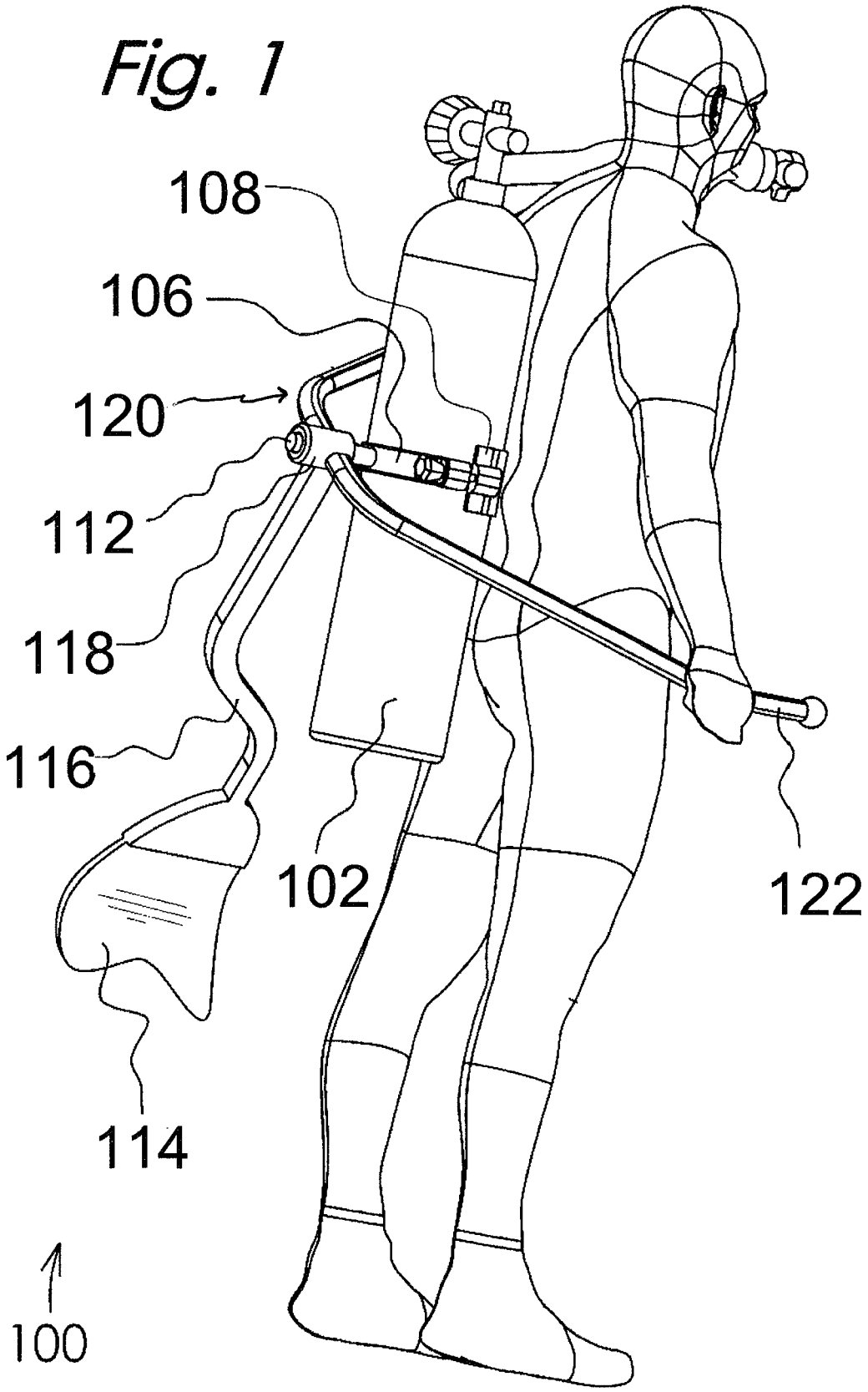
FIG. 1 is a perspective view of a diver outfitted with an oscillating fin apparatus.

Referring first to FIG. 1, a scuba diver is illustrated outfitted with an oscillating fin propulsion apparatus. The propulsion apparatus is generally identified by the reference numeral 100. An air tank 102, including valves and associated regulator and hose, may be secured to the diver by means known in the art.

Figure 3:
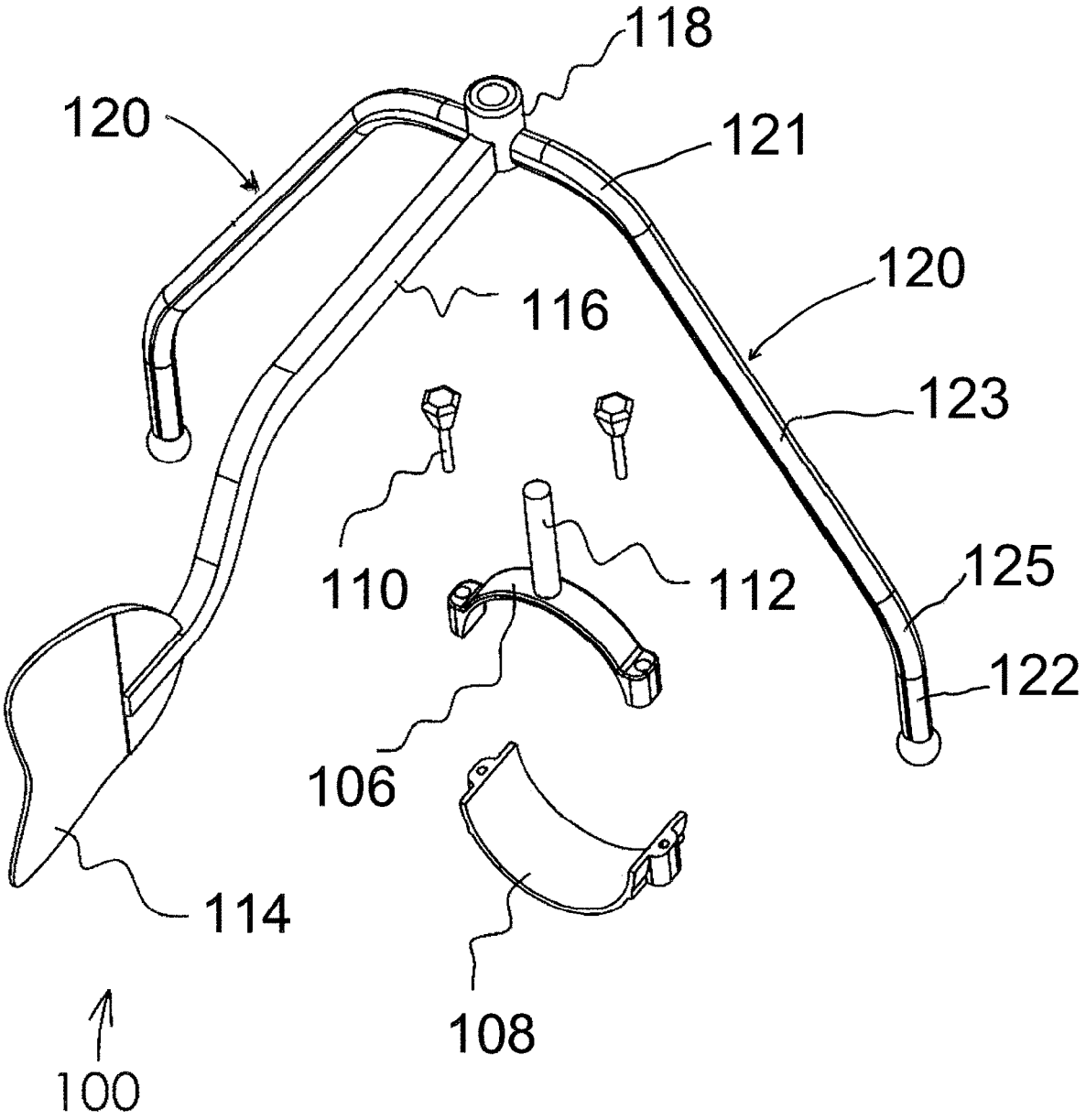
FIG. 3 is an explode perspective view of the oscillating fin apparatus shown in FIG. 1.
Figure 4:
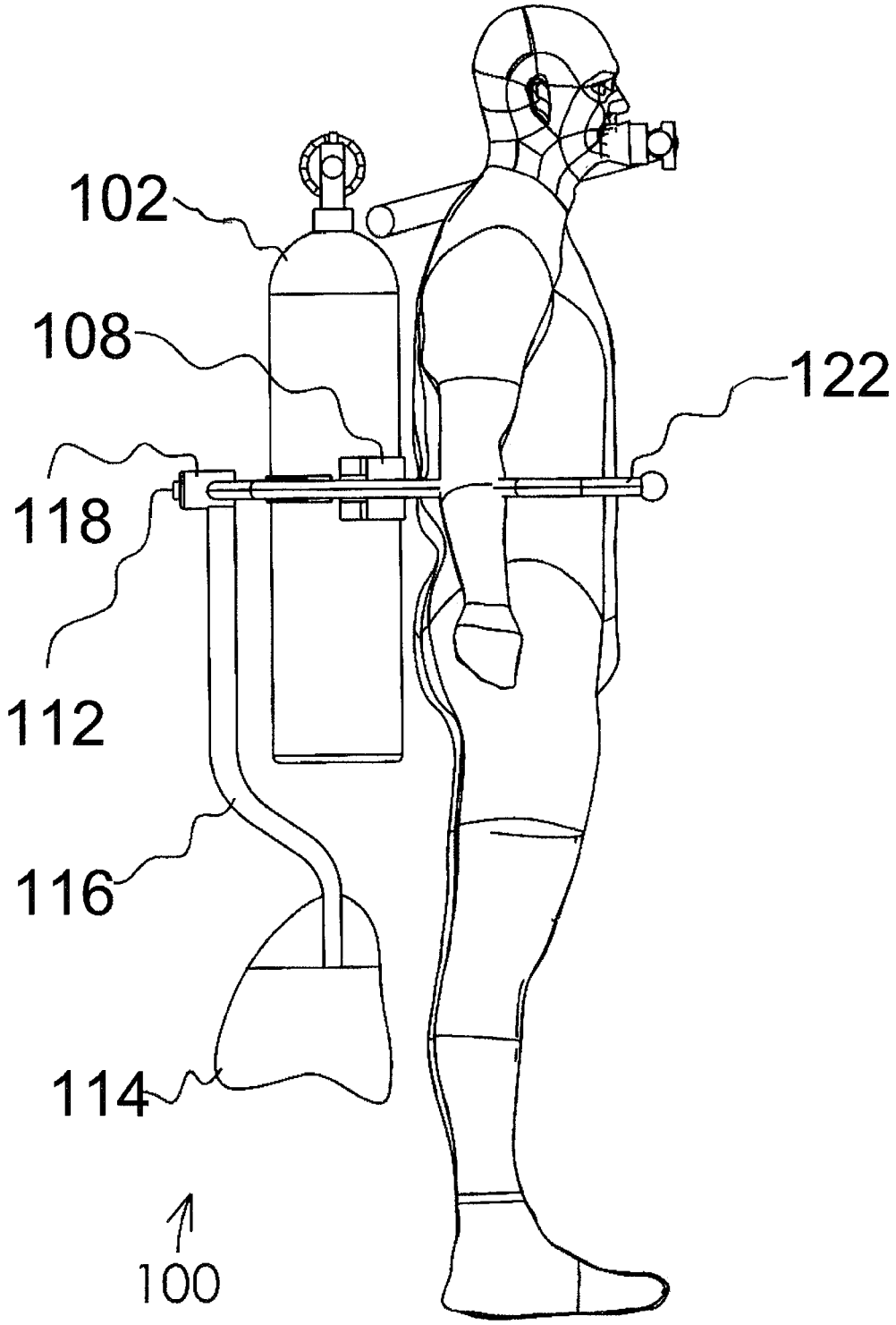
FIG. 4 is a side view of the diver shown in FIG. 1 outfitted with the oscillating fin apparatus.

The propulsion apparatus 100, shown in greater detail in FIG. 3, may include a split clamp 104 comprising a top clamp hag member 106 and a bottom clamp member 108. The clamp members 106, 108 may clamp about the scuba tank 102 to secure the split clamp 104 to the scuba tank 102 upon tightening the screws or bolts 110. A post 112 may be rigidly secured to the top clamp member 106 and establish an axis A about which fin 114 may oscillate. The post 112 may extend generally perpendicular to a plane defined by the oscillating movement of the fin 114. The post 112 may define a pivot axis substantially perpendicular to a longitudinal axis of the scuba tank 102. However, a slight deviation from perpendicular may be desired in order to minimize pitching motion while the fin 114 is oscillating.

Referring now to FIG. 3, the fin 114 may be fixedly connected to a distal end of an elongated shaft 116. The shaft 116 may be fixedly connected to a journal bearing 118. Right and left arm members 120 may likewise be fixedly connected to the journal bearing 118. The arm members 120 may extend in opposite directions to either side of the scuba tank 102 substantially perpendicular to the longitudinal axis of the shaft 116.

Figure 2A:
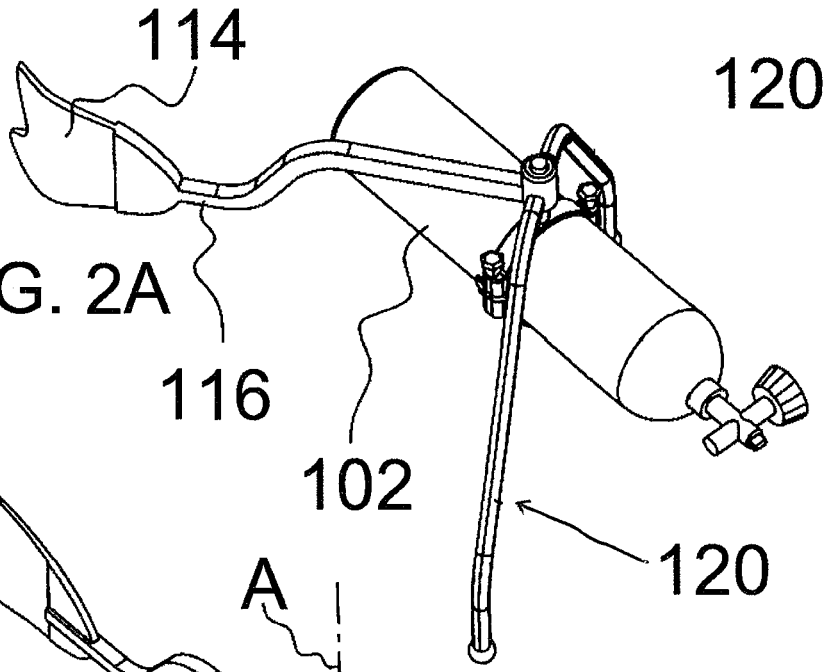
FIGS. 2A-2C are perspective views illustrating multiple positions of the fin of the oscillating fin apparatus shown in FIG. 1.
Figure 2B:
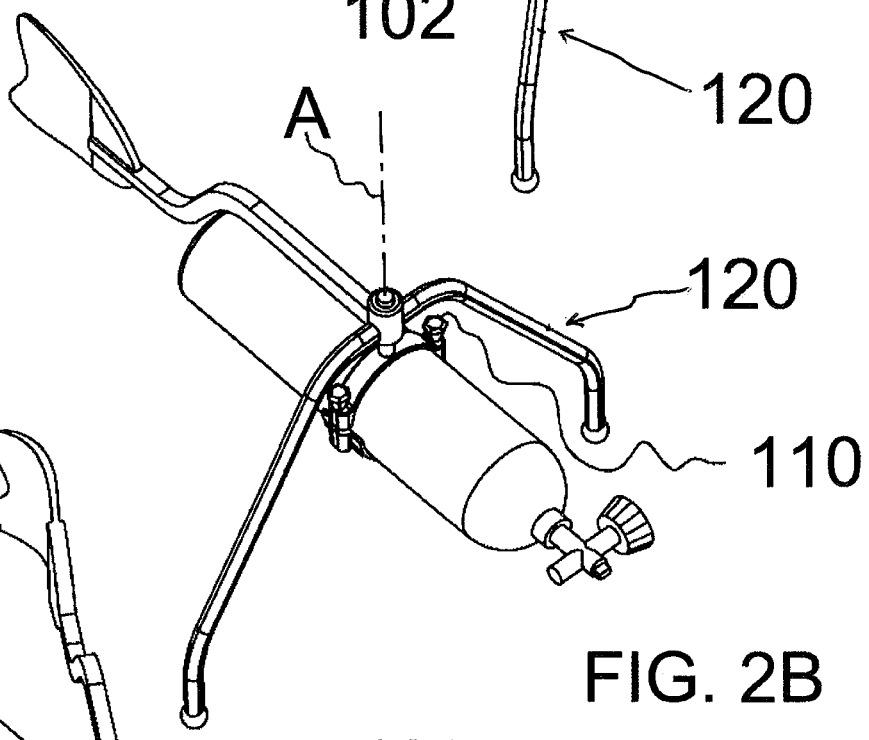
Figure 2C:
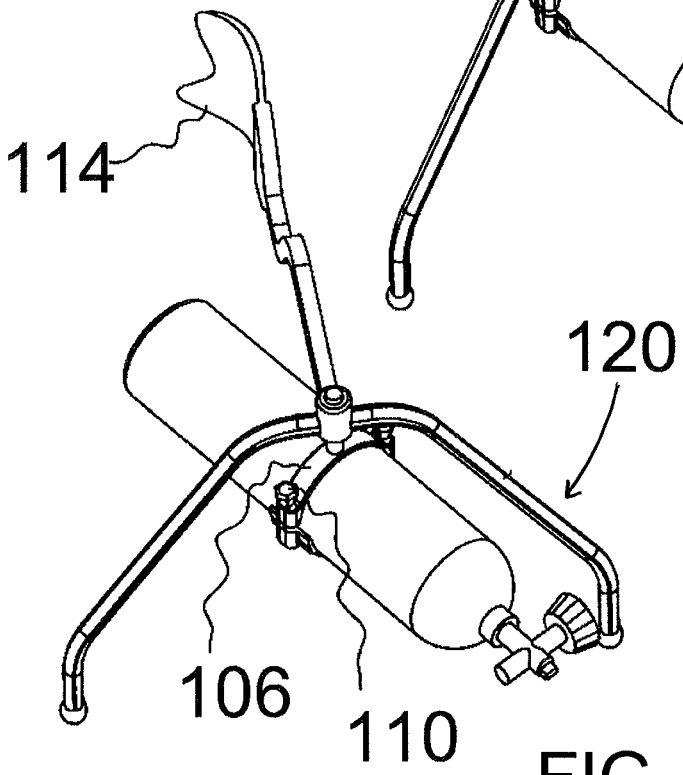

It may be observed that the fin shaft 116 may include an elongated straight or linear portion extending from the journal bearing 118 and a downwardly curved distal portion terminating at the fin 114. As more clearly shown in FIGS. 2A-2C, the straight portion of the fin shaft 116 may extend slightly beyond the end of the scuba tank 102. The downward extent of the curved portion of the fin shaft 116 positions the fin 114 so that the longitudinal axis of the fin 114 is substantially colinear with the longitudinal axis of the scuba tank 102.

Referring sill to FIG. 3, the left and right arm members 120 may include a distal portion 121 extending from the shank journal 118, an intermediate portion 123 extending at an angle from the distal portion 121, and a proximal portion 125 terminating in hand grips 122. The hand grips 122 may be easily grasped by the diver to operate the propulsion apparatus 100.

Figure 5:
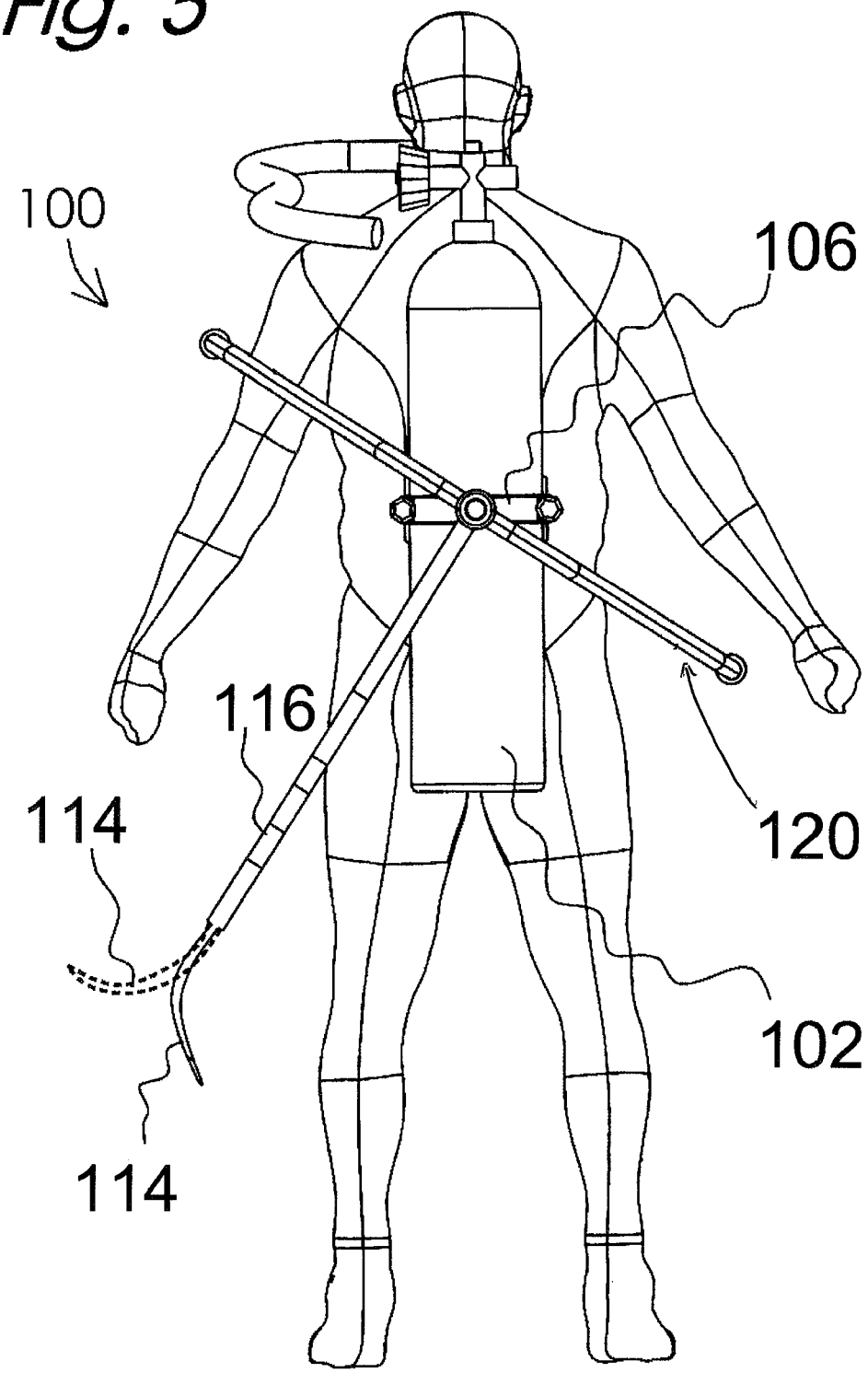
FIG. 5 is a back view of the diver shown in FIG. 1 outfitted with the oscillating fin apparatus.

During operation, the trailing edge of the fin 114 may flex away from the direction of transverse motion of the fin 114, as illustrated in FIG. 5. Typically, the fin shank 116 may oscillated about the shaft 112 plus and minus 45° (+/−45°) resulting in a total sweeping motion of about ninety (90°) degrees. However, when executing a turn, the fin shank 116 oscillation may be limited or biased to one side, with the resulting momentum vector steering the diver the opposite side. In situations where the diver may be underwater kelp and the like, the total range of fin oscillation may only be a few degrees and yet significant forward propulsion may still be provided by the propulsion apparatus 100.

A previously noted, the propulsion apparatus 100 may be used only for steering or yaw control, particularly by an able-bodied diver where propulsion may be provided by a pair of unillustrated foot fins. The oscillating apparatus 100 may also be used to provide a combination of propulsion and steering, where a diver's effort is divided between using his arms to operate the arm members 120 in a reciprocating manner and/or the diver kicking his feet to provide forward propulsion.

While a preferred embodiment of an oscillating propulsion apparatus has been shown and described, other and further embodiments of the oscillating propulsion apparatus may be devised without departing from the basic scope thereof, and the scope thereof is determined by the claims which follow.

The invention claimed is:

1. A scuba propulsion apparatus removably mounted on a scuba tank, comprising:

a) left and right arm members fixedly secured to a journal bearing;

b) a fin shaft fixedly secured to said journal bearing, said fin shaft extending from said journal bearing substantially perpendicular to said left and right arm members;

c) a clamp removably coupled to the scuba tank, said clamp including a post extending substantially vertically from said clamp;

d) said journal bearing pivotally coupling said left and right arm members and said fin shaft to said post; and e) a fin fixedly connected to a distal end of said fin shaft.

2. The scuba propulsion apparatus of claim 1 wherein said clamp includes a top clamp member and a bottom claim member removably secured about the scuba tank.

3. The scuba propulsion apparatus of claim 1 wherein said fin shaft includes a straight portion and a downwardly curved distal portion, said straight portion extending beyond a distal end of the scuba tank.

4. The scuba propulsion apparatus of claim 1 wherein said left and right arm members include a distal portion, an intermediate portion and a proximal portion, said intermediate portion extending at an angle from said distal portion and said proximal portion terminating at a hand grip.

5. A scuba propulsion apparatus, comprising:

a) a split clamp removably secured to a scuba tank, said split clamp including a top clamp member and a bottom clamp member;

b) a post projecting substantially vertically from said top clamp member, said post defining a pivot axis substantially perpendicular to a longitudinal axis of the scuba tank;

c) a left arm and a right arm pivotally connected to said split clamp;

d) an elongated shaft pivotally connected to said split clamp, and e) a fin fixedly connected to a distal end of said shaft.

6. The scuba propulsion apparatus of claim 5 wherein said shaft includes a straight portion and a downwardly curved distal portion, said straight portion extending beyond a distal end of the scuba tank.

* * * * *